US005533918A

United States Patent [19]

Sanders

[11] Patent Number: 5,533,918

[45] Date of Patent: Jul. 9, 1996

[54] SURFER'S FIN

[75] Inventor: Stan A. Sanders, 420 29th St., Hermosa Beach, Calif. 90530

[73] Assignees: Stan A. Sanders; William F. Meistrell, both of Mangattan Beach, Calif.; a part interest

[21] Appl. No.: 368,540

[22] Filed: Jan. 4, 1995

[51] Int. Cl.[6] ..... A63B 31/08

[52] U.S. Cl. ..... 444/64

[58] Field of Search ..... 441/61, 64

[56] References Cited

U.S. PATENT DOCUMENTS 2,889,563 6/1959 Lamb et al. ..... 441/64

FOREIGN PATENT DOCUMENTS 1501208 11/1967 France ..... 441/61

1294358 3/1987 U.S.S.R. ..... 441/64

OTHER PUBLICATIONS

"Bodyboarding", summer quarter 1994, pp. 50 and 51, Powertools, the Ins and Outs of Fins.

*Primary Examiner*—Jesus D. Sotelo

*Attorney, Agent, or Firm*—William W. Haefliger

[57] ABSTRACT

In a swim fin unit for use on the foot of a swimmer, the combination, comprises a body defining a foot receptacle, that opens endwise forwardly; first fin structure integral with and extending generally rearwardly of the body to be flexed upwardly and downwardly rearwardly of the body, by water pressure; and second fin structure integral with and extending generally vertically rearwardly relative to the body; said first fin structure defining a first plane and the second fin structure defining a second plane; the first and second planes intersecting in generally perpendicular relation.

5 Claims, 4 Drawing Sheets

SURFER'S FIN

BACKGROUND OF THE INVENTION

This invention relates generally to swim fins, and more particularly to improvements in such fins enabling enhanced maneuverability of the swimmer to whose foot or feet the swim fin or fins are attached.

Swimmers such as surfers and bodyboard users commonly attach swim fin units to their feet to gain greater maneuverability. This occurs due to kicking which causes the fins to flex and push against the water with greater force than is possible using the feet alone. While different types of fin units have been constructed and used, none embody the unusual advantages in construction, modes of operation and results enabled by the present invention, to my knowledge.

SUMMARY OF THE INVENTION

It is a major object of the invention to provide an improved fin unit which meets the needs for significantly enhanced maneuverability realized when used by a surfer, swimmer or surf or body board user. Basically, the unit comprises, in combination:

a) a body defining a foot receptacle, that opens endwise forwardly, b) first fin means integral with and extending generally rearwardly of the body to be flexed upwardly and downwardly rearwardly of the body, by water pressure, c) and second fin means integral with and extending generally vertically rearwardly relative to the body, d) the first fin means defining a first plane and the second fin means defining a second plane, e) the first and second planes intersecting in generally perpendicular relation.

As will appear, the first and second fin means typically have cantilever connection to the body, whereby the unit may have one-piece molded construction, and the unit may consist of hard elastomeric material, such as rubber.

Another object includes the provision of first fin means structure to include two spaced sections between which the second fin means extends; and such sections may merge forwardly of a portion of said second fin means that projects downwardly through a plane defined by the first fin means. In this regard, the second fin means is typically sidewardly flexible rearwardly of the body, and to limited extent as determined by its proximity to the first fin means. As will be seen, when the first fin means flexes upwardly to considerable extent, the second fin means may then flex laterally, producing sideward thrust, whereby the surfer can control sideward flexing and sideward thrust by first inducing upward flexing of the first fin means to considerable extent. Accordingly, the first fin means has an upwardly deflected position beneath which said second fin means is sidewardly deflectable.

Another object is to provide the recessed fin means to have a reduced height forward position integral with said body, above the level of said first fin means.

These and other objects and advantages of the invention, as well as the details of an illustrative embodiment, will be more fully understood from the following specification and drawings, in which:

DRAWING DESCRIPTION

DETAILED DESCRIPTION

Figure 1:
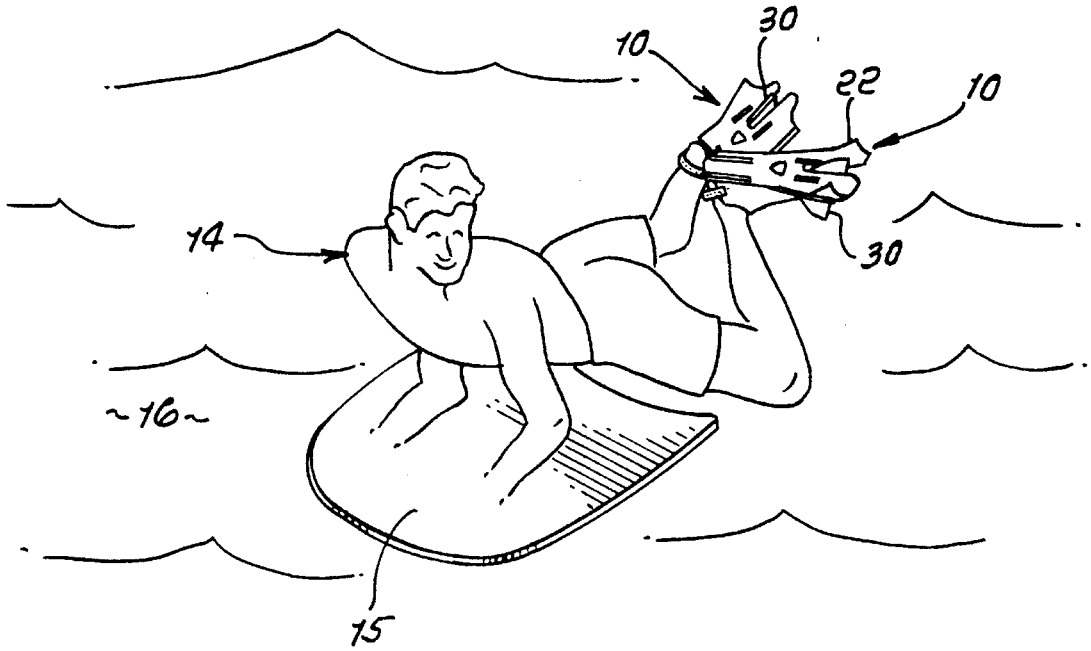
FIG. 1 is a perspective view of a swimmer or surfboarder using swim fin units of the present invention.

In the drawings, a swim fin unit 10 defines a body molded of hard elastomeric material, such as rubber, so as to comprise a one-piece integral unit. It includes a foot receptacle 11 that opens at 11*a*, endwise forwardly, to receive the foot 12 of the wearer. The unit is depicted in the position as worn, with the wearer's body facing downwardly, as in the water. See the body board swimmer 14 in FIG. 1, using board 15, as in the ocean or lake 16.

Figures 3, 4:
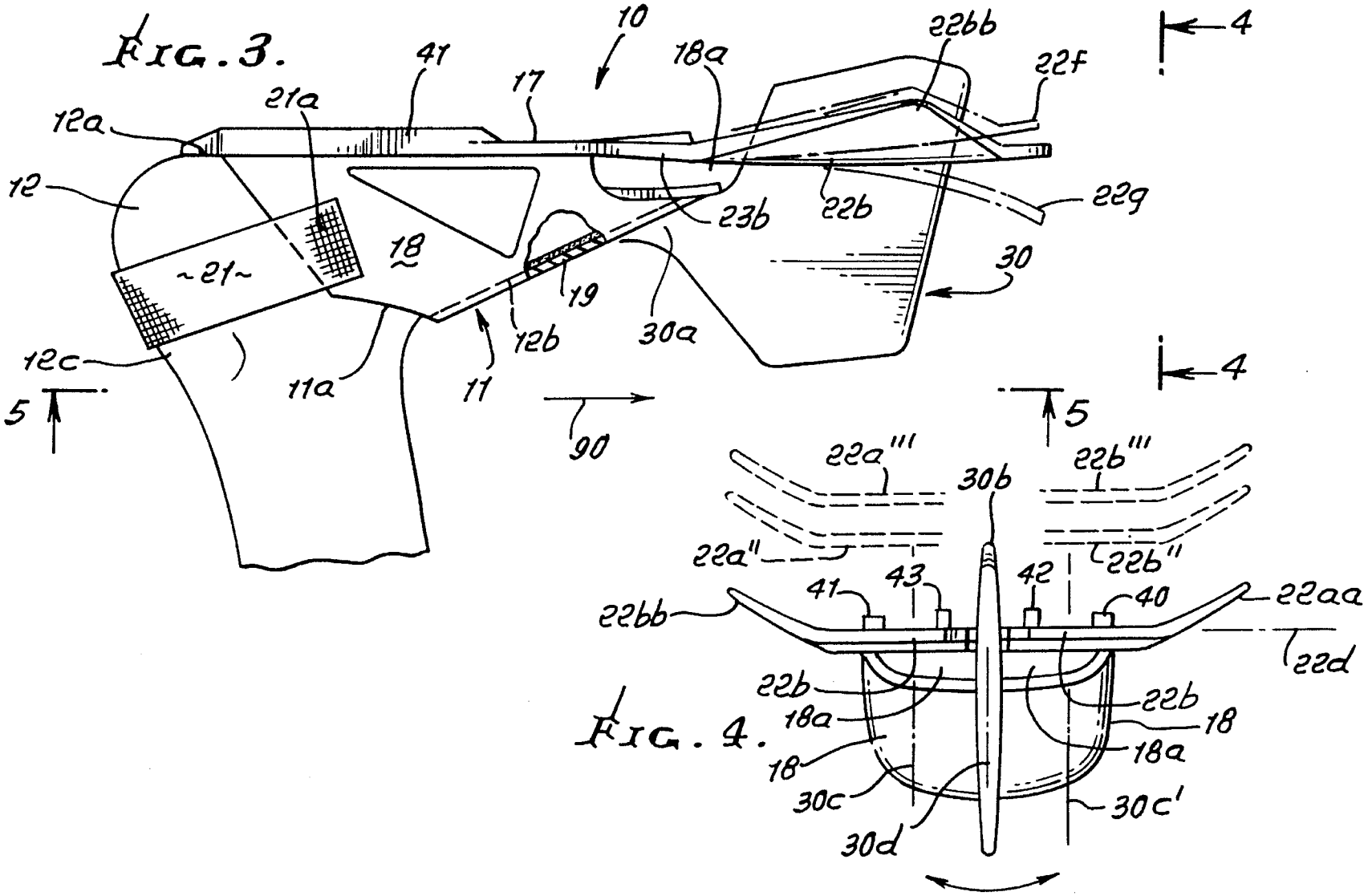
FIG. 3 is a side elevation taken on lines 3—3 of FIG. 2.
FIG. 4 is an end elevation taken on lines 4—4 of FIG. 3.
Figure 5:
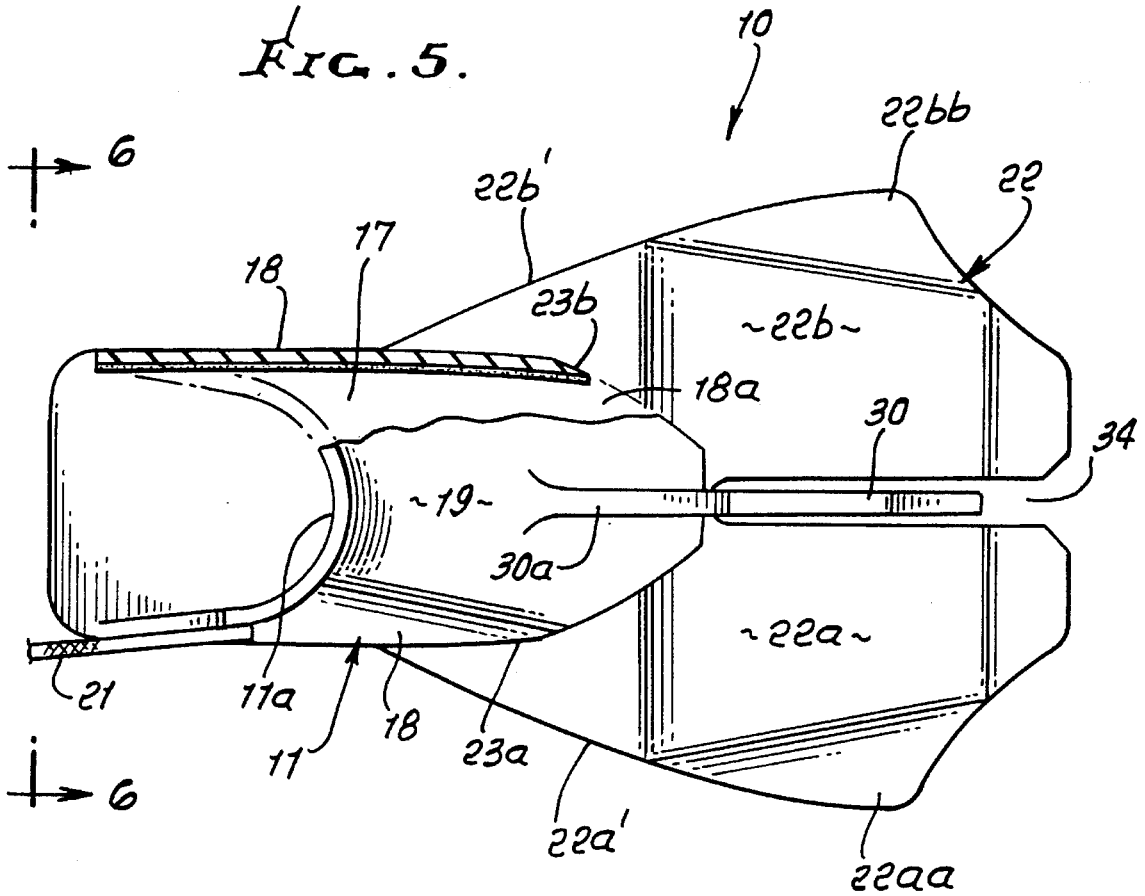
FIG. 5 is a bottom plan view of the unit, as used.
Figure 6:
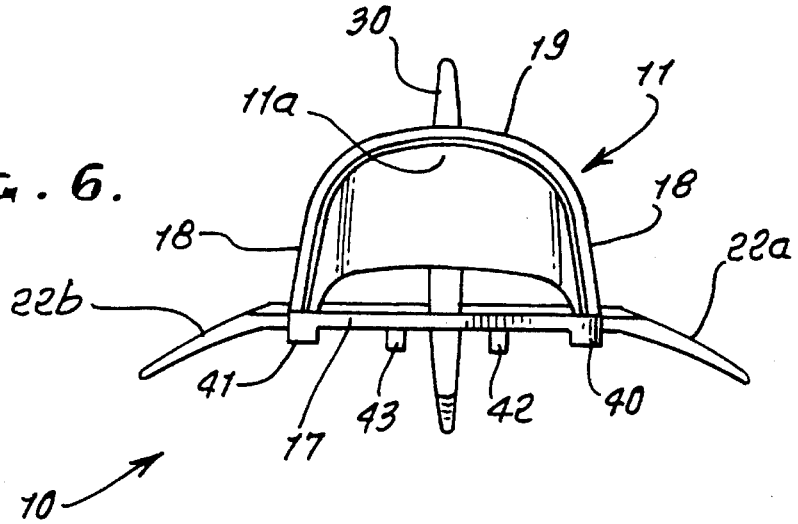
FIG. 6 is an end elevation taken on lines 6—6 of FIG. 5.

The foot receptacle 11 has a flat sole 17, side walls 18 and a wall 19 opposite 17. The bottom 12*a* of the user's foot engages the sole plate or wall 17, as shown in FIG. 3, and the opposite wall 19 is angled downwardly and forwardly (in the direction of the swimmer's movement) to match the user's foot configuration at 12*h*. A retainer strap 21 may be attached at 21*a* to the side walls for wrapping over the user's heel 12*c*, as shown. Walls 18 and 19 form an arch that is angled rearwardly so that the foot reception area diminishes, rearwardly, in the direction of arrow 90.

In accordance with the invention, first fin means is provided to be integral with the body 10, and to extend generally rearwardly of the body to be flexed upwardly and downwardly, rearwardly of the body, as by water pressure exerted on the upper or lower faces of the first fin means. See the fin means 22 having left and right sections 22*a* and 22*b*. The latter have forward extents that merge with the sole wall 17, at the inner perimeters 23*a* and 23*b* of the sections, below side walls 18. The outer and forward boundaries of the sections 22*a* and 22*b* taper forwardly at 22*a'* and 22*b'*. Side walls 18 are cut-away at openings 18*a* to pass water from the interior of the receptacle under the horizontally extending fin sections 22*a* and 22*b* , and also to accommodate to the wearer's toes.

Second fin means is also provided to be integral with the body, and to extend generally vertically and rearwardly relative to the body. See second fin 30 having a forward portion 30*a* merging with the body at the rearward tapering extent of wall 19, as shown. The first fin means (as for example defined by sections 22*a* and 22*b*) defines a first generally horizontal plane 22*d*, and the second fin means defines a second generally vertical plane 30*d;* and the two planes intersect in generally perpendicular relation, as shown in FIG. 4. Also, it will be noted that the first and second fin means have cantilever connections to the body, at their forwardmost extents, whereby flexing of the first and second fin means is enabled, their reduced thicknesses enabling flexing in such manner as to exert forward and other (up, down and sideward) thrust components as the user's foot controllably moves or maneuvers in the water.

Further, it will be noted that the two sections 22*a* and 22*b* are separated by a forwardly extending gap or split 34 of width substantially in excess of the thickness of the fin 30, the latter projecting through the split, in unflexed condition. See FIG. 2. Therefore, the sections 22*a* and 22*b* block sidewise flexing of fin 30 beyond a small amount, so long as the sections 22*a* and 22*b* are not themselves flexed by water pressure to carry the split or gap beyond the periphery of the fin 30. FIG. 4 shows an upwardly flexed conditions of the sections 22*a* and 22*b*. See broken lines 22*a*" and 22*b*" above the level of fin 30 edge 30*b*, (and broken lines 22*a*'" and 22*b*'" also above the level of fin 30 edge 30*b* (and representing a further deflection of sections 22*a* and 22*b*) allowing substantial sideward flexing of fin 30, as to limits 30*c* and 30*c*' indicated by broken lines in FIG. 4. FIG. 3 also shows upward and downward deflections of the fins 22*a* and 22*b*, as at 22*f* and 22*g*.

Note also that the sections 22*a* and 22*b* have upwardly angled outer edge portions 22*aa* and 22*bb*, in FIG. 4, acting to add stability to the first fin means, in use in the water. Sections 22*a* and 22*b* can resiliently and yieldably deflect upwardly and downwardly to different extents, depending upon water pressure at opposite sides of fin 30, adding to even greater maneuverability. Thus, section 22*a* might deflect upwardly sufficiently that fin 30 can deflect sidewardly beneath 22*b*, while section 22*b* remains below edge level of fin 30, to block its flexing below 22*b*.

Figure 2:
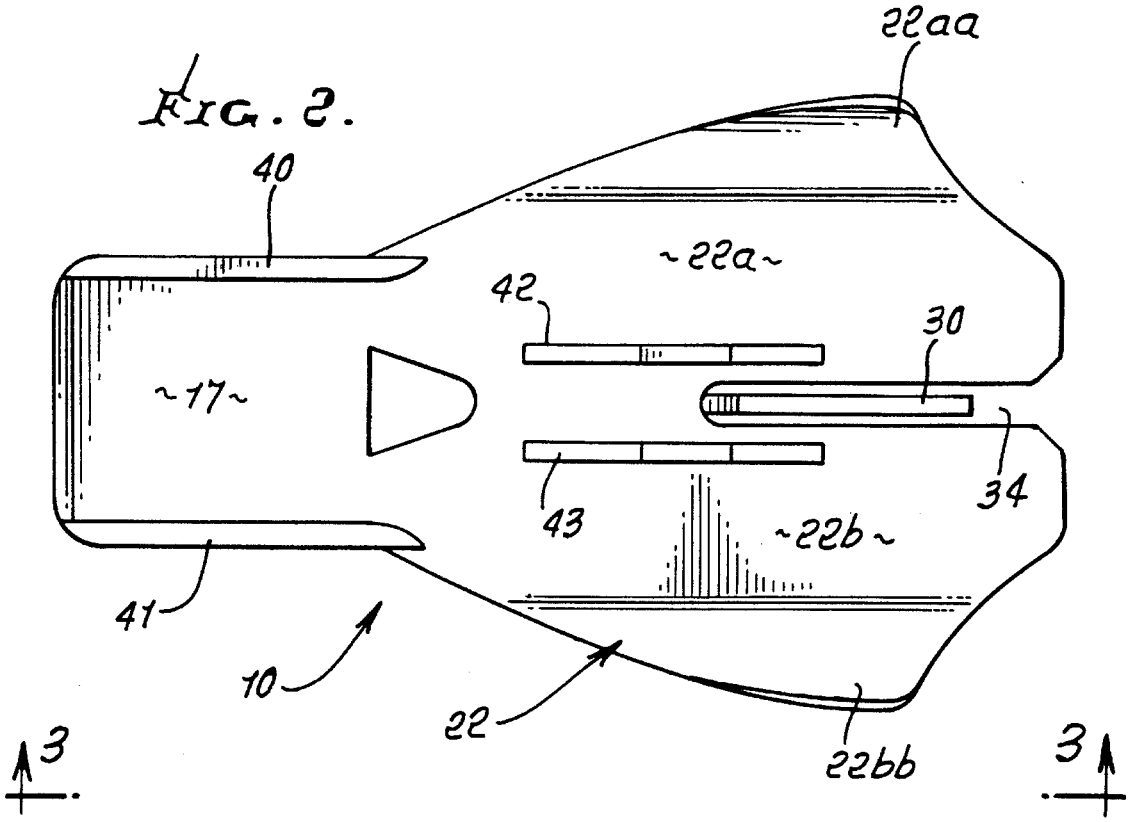
FIG. 2 is a top plan view of a swim fin, as used.

Flow straightening guides project lengthwise and outwardly from sole 17, as at 40–43, in FIGS. 2–4.

Figure 7:
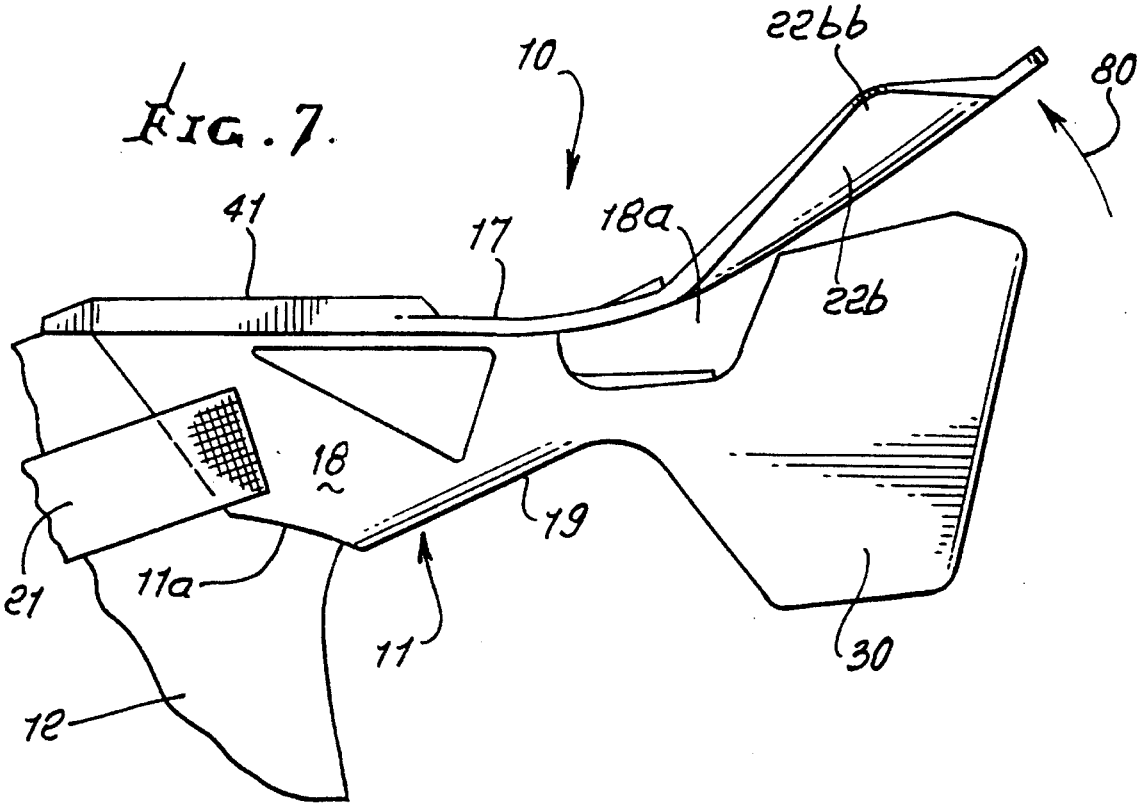
FIG. 7 is a view like FIG. 3.
Figure 8:
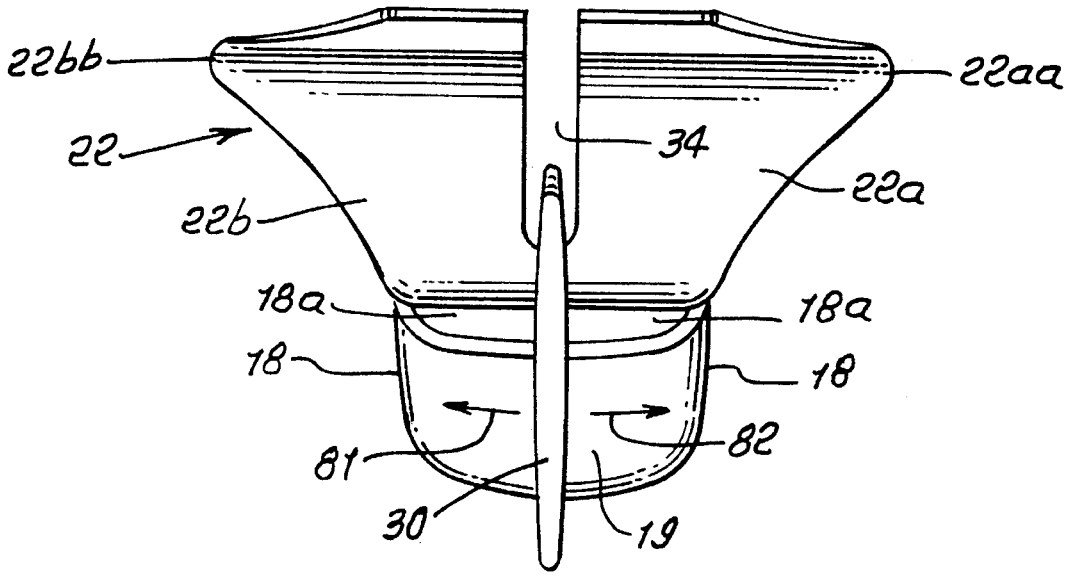
FIG. 8 is a view like FIG. 4.

FIGS. 7 and 8 show first fin means 22 in an upwardly flexed, elevated position, relative to second fin means 30, allowing the latter to flex left and right. Water pressure flexes fin means 22; see arrow 80. FIG. 8 shows that fin means 30 can thus flex left and right, as indicated by arrows 81 and 82.

I claim:

1. In a swim fin unit for use on the foot of a swimmer, the combination, comprising a) a body defining a foot receptacle, that opens endwise forwardly, b) first fin means integral with and extending generally rearwardly of the body to be flexed upwardly and downwardly rearwardly of said body, by water pressure, c) and second fin means integral with and extending generally vertically rearwardly relative to said body, d) said first fin means defining a first plane and said second fin means defining a second plane, e) said first and second planes intersecting in generally perpendicular relation, f) said first and second fin means having cantilever connection relative to said body, g) said first fin means including two horizontally spaced sections between which said second means extends, there being a forwardly extending and rearwardly open gap between said sections, said second fin means extending vertically in said gap, said second fin means being sidewardly flexible in said gap as limited by the width of said gap, h) said sections having upwardly bodily deflected positions characterized in that the second fin means is sidewardly deflectable beneath said sections and gap, i) said sections having upwardly angled stabilizing edge wings spaced from said gap.

2. The combination of claim 1 wherein said two sections merge, forwardly of a portion of said second fin means that projects downwardly through a plane defined by the first fin means.

3. The combination of claim 2 wherein said second fin means has a reduced height forward portion integral with said body, above the level of said first fin means.

4. The combination of claim 1 wherein said fin unit consists of hard elastomeric material.

5. The combination of claim 1 wherein said unit including said body and said first and second fin means is of one-piece molded construction.

* * * * *